United States Patent [19]

Abe et al.

[11] Patent Number: 4,516,543

[45] Date of Patent: May 14, 1985

[54] CIRCUIT FOR CONTROLLING GLOW PLUG ENERGIZATION

[75] Inventors: Yoshiaki Abe, Higashimatsuyama; Yutaka Nishimura, Kawagoe; Hitoshi Sugimoto, Higashimatsuyama, all of Japan

[73] Assignee: Diesel Kiki Co., Ltd., Tokyo, Japan

[21] Appl. No.: 386,911

[22] Filed: Jun. 10, 1982

[30] Foreign Application Priority Data

Jun. 10, 1981 [JP] Japan ..... 56-088294

[51] Int. Cl.[3] ..... F02N 17/00

[52] U.S. Cl. ..... 123/179 H; 219/497; 123/179 BG; 123/145 A

[58] Field of Search ..... 123/179 H, 179 BG, 145 A; 219/491, 497, 499, 202

[56] References Cited

U.S. PATENT DOCUMENTS

| | | | |
|---|---|---|---|
| 4,207,853 | 6/1980 | Phillips | 123/179 BG |
| 4,300,491 | 11/1981 | Hara et al. | 123/179 H |
| 4,377,138 | 3/1983 | Mitani et al. | 219/497 |
| 4,399,781 | 8/1983 | Tsukasaki | 219/497 |

FOREIGN PATENT DOCUMENTS

| | | | |
|---|---|---|---|
| 117836 | 9/1979 | Japan | 123/179 H |
| 123373 | 9/1980 | Japan | 123/145 A |

*Primary Examiner*—Parshotam S. Lall

*Attorney, Agent, or Firm*—Guy W. Shoup; Gerard F. Dunne

[57] ABSTRACT

A circuit for controlling glow plug energization for use with a diesel engine having at least one glow plug energized by actuation of an ignition switch. The circuit has a simulator for producing a simulation signal indicative of glow plug temperature, a generator for generating a reference signal with a level which is determined in relation to a desired glow plug temperature and which is changed in magnitude in response to the change in the voltage of said voltage source and the temperature of the engine coolant, and a switch responsive to the result of comparing the simulation signal with the reference signal for controlling the flow of the current from said power source to the glow plug to energize the glow plug, whereby the glow plug is energized so as to be heated to said desired glow plug temperature.

10 Claims, 7 Drawing Figures

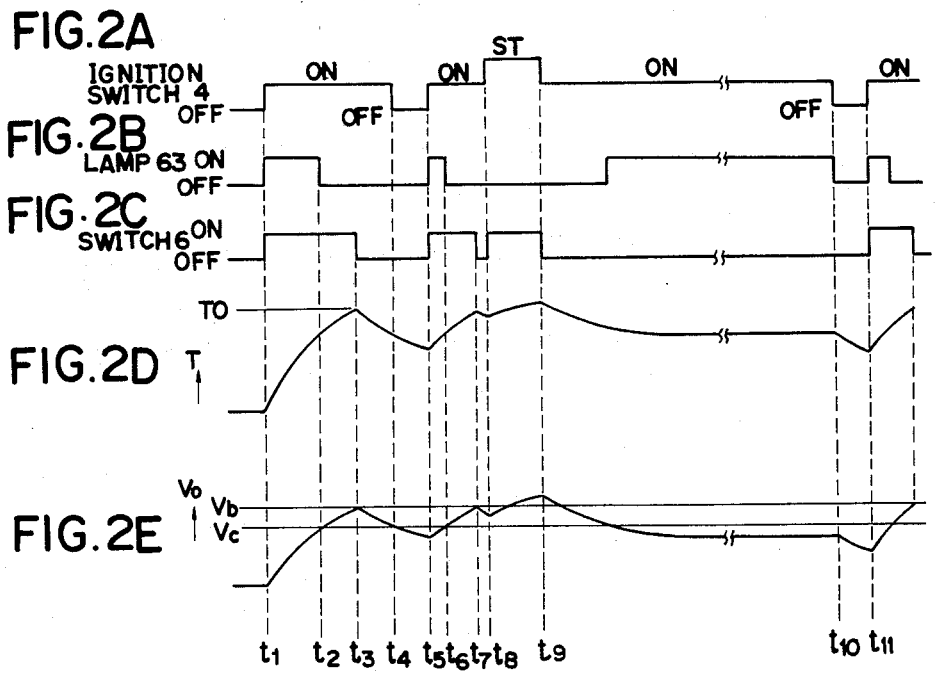
FIG. 3
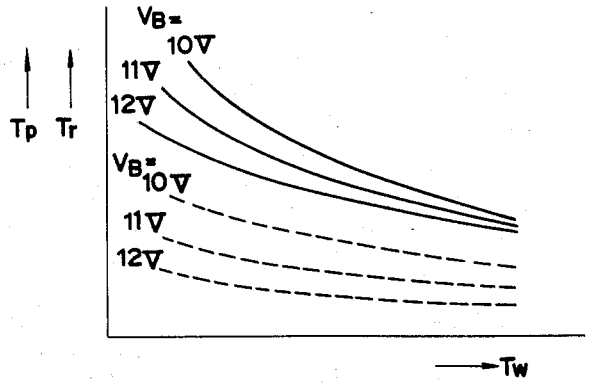

CIRCUIT FOR CONTROLLING GLOW PLUG ENERGIZATION

The present invention relates to a circuit for controlling glow plug energization, and more particularly to a diesel engine glow plug energization control circuit which is capable of heating glow plugs to a predetermined temperature.

As is well known, it is necessary to heat the glow plugs of a diesel engine so as to raise the temperature of the engine's combustion chambers prior to engine cranking. The conventional glow plug energization control circuit for this purpose is so arranged that a constant reference voltage stabilized by means of, for example, a zener diode is compared in level with an output voltage from a glow plug temperature simulator circuit including a capacitor, and the current flowing through one or more glow plugs is controlled in accordance with the results of the comparison, However, when such a constant voltage produced by a zener diode is employed as a reference voltage, the voltage characteristics of the glow plugs cannot be fully compensated for even though the time period for preheating the glow plugs (that is, the time period for passage of the heating current) is extended proportionally as the battery voltage drops. As a result, the glow plug temperature is liable to be lower when the battery voltage is lower. Moreover, it is another disadvantage of the conventional circuit that even if the terminal voltage of the battery is maintained constant, the starting condition of the engine depends upon the temperature of the coolant for the engine or the like, and is often not taken into consideration. Proper heating control of the glow plugs cannot, therefore, be carried out in accordance with the actual operation of the engine.

In the prior art circuit, in order to prevent the service lives of the glow plugs from being shortened by overheating and to prevent electric power from being wasted when the ignition switch is kept in the ON state, there is provided a circuit for cutting off the current flowing through the glow plugs regardless of the state of output level of the comparator when a predetermined time has passed after the ignition switch is switched over to its ON position. However, such a circuit requires a timer circuit, and moreover requires more parts, so that the cost is increased and the reliability is reduced. Furthermore, in order to prevent the glow plugs from being overheated when the engine is started again just after once being stopped, the conventional circuit is so arranged that a predetermined voltage based on the voltage appearing at the charge lamp terminal of a generator with which the engine is equipped is applied to the capacitor for simulating the temperature of the glow plugs. However, such an arrangement requires an additional conducting line for connecting the charge lamp terminal of the generator to the circuit for controlling glow plug energization, so that the reliability of the circuit will be reduced.

It is, therefore, an object of the present invention to provide an improved circuit for controlling glow plug energization.

It is another object of the present invention to provide a circuit for controlling glow plug energization which is capable of heating the glow plugs to a predetermined temperature regardless of changes in the voltage of the power source, and free from the influence of changes in the coolant temperature.

It is a further object of the present invention to provide a circuit for controlling glow plug energization which can effectively prevent the glow plugs from being overheated when the engine is restarted just after being stopped.

According to the present invention, there is provided a glow plug energization control circuit for use with diesel engines having at least one glow plug energized by actuation of an ignition switch having an OFF position, an ON position for connecting the circuit to a voltage source, and an ST position for starting the diesel engine, wherein said circuit comprises: a first circuit for producing a simulation voltage signal with a level which changes substantially in accordance with the change of glow plug temperature upon glow plug energization and deenergization; a second circuit for generating a first reference voltage signal with a level which is determined in relation to a desired glow plug temperature and which is changed in magnitude in response to the change in the voltage of said voltage source and the temperature of the coolant for the engine; means for comparing the level of the said simulation voltage signal with that of said first reference voltage signal; and a switching means responsive to the resulting output of said comparing means for controlling the flow of the current from said power source to the glow plug to energize the glow plug, whereby the glow plug is energized so as to attain said desired glow plug temperature.

Further objects and advantages of the invention will be clear from the following detailed description to be read in conjunction with the accompanying drawings in which:

FIGS. 2A to 2E are timing charts for explaining the operation of the device illustrated in FIG. 1; and FIG. 3 is a graph illustrating characteristic curves of the relationship between the coolant temperature and the time required for heating the glow plug and the relationship between the coolant temperature and the lighting time of a lamp.

Figure 1:
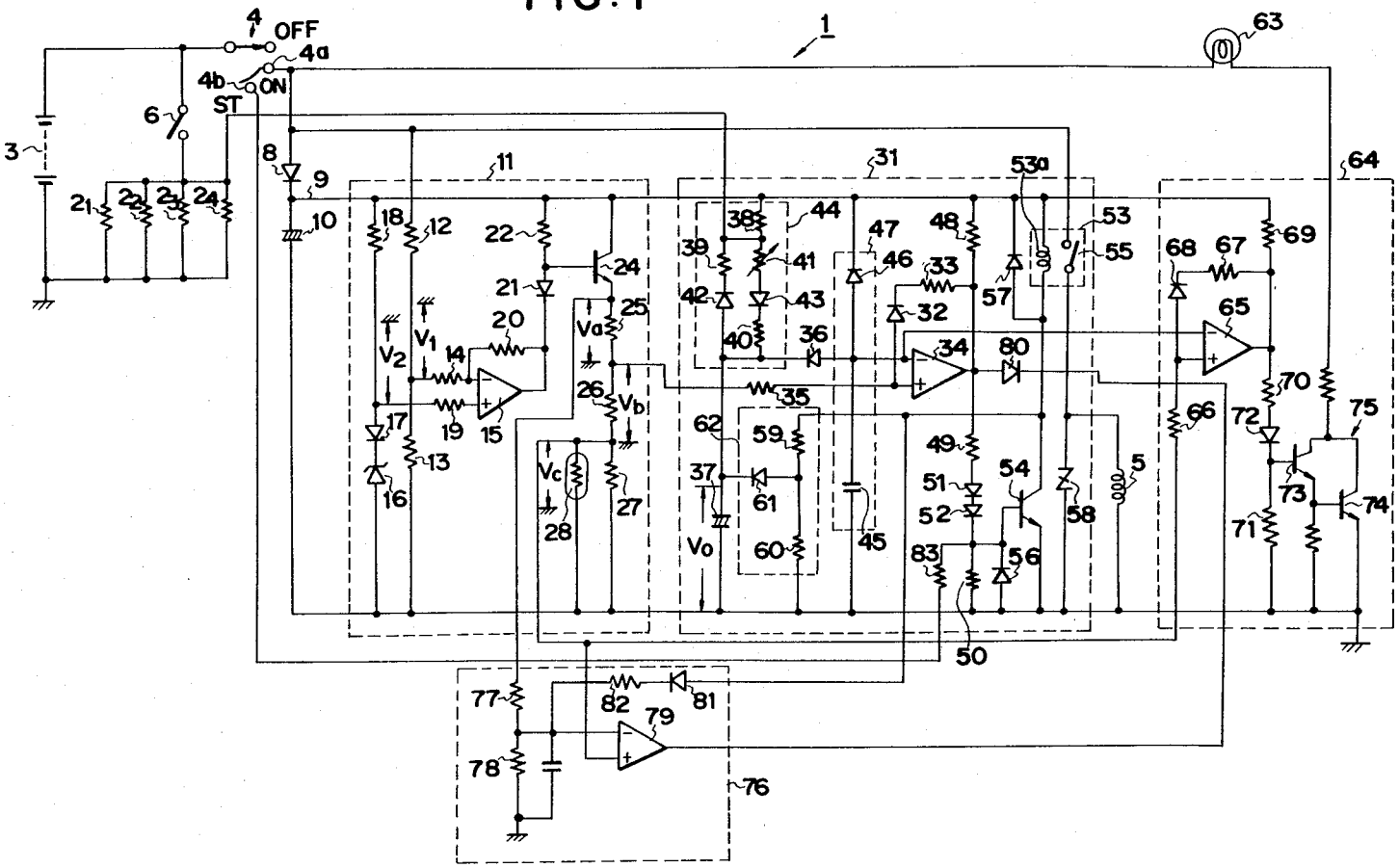
FIG. 1 is a schematic diagram of an embodiment of present invention.

Referring to FIG. 1, there is shown an embodiment of the glow plug energization control circuit of the present invention. A control circuit 1 controls the preheating condition of glow plugs $2_1$ to $2_4$ provided for the respective cylinders of a four-cylinder diesel engine (not shown) by controlling the heating current flowing through the glow plugs $2_1$ to $2_4$ from a battery 3 when an ignition switch 4 is switched to its ON position or its ST position. One terminal of each of the glow plugs $2_1$ to $2_4$ is connected to the negative terminal of the battery 3 and is also grounded, and the other terminal of each is connected to the positive terminal of the battery 3 through a switch 6 which is closed/opened in accordance with the energization/deenergization of a relay coil 5. A stationary contact $4_a$ for the ON position of the ignition switch 4 is connected to a positive line 9 through a diode 8, and a capacitor 10 having a large capacitance is connected between the positive line 9 and the ground.

The reference numeral 11 designates a reference voltage generating circuit which includes an operational amplifier 15 having an inverting input terminal to which a voltage $V_1$ is applied through a resistor 14. The voltage $V_1$ is produced by a voltage dividing circuit composed of resistors 12 and 13 which is connected between the stationary contact $4_a$ and ground. The operational amplifier 15 has also a non-inverting input terminal to which a voltage $V_2$ is applied through a resistor 19. Since the voltage $V_2$ is a voltage developed across a zener diode 16 and a diode 17, the level of the voltage $V_2$ is free from the influence of changes in the terminal voltage of the battery 3. A resistor 18 is provided as a current limiting resistor for limiting the current flowing through the zener diode 16. The output terminal of the operational amplifier 15 is connected through a feedback resistor 20 to the inverting input terminal. Consequently, only the level of the voltage $V_1$ varies on the input side of the operational amplifier 15 in accordance with the change in the terminal voltage of the battery 3, so that the output voltage of the operational amplifier 15 is changed in level in accordance with the terminal voltage of the battery 3.

A diode 21 and a resistor 22 are connected between the output terminal of the operational amplifier 15 and the positive line 9, and the voltage appearing at the connecting point of the diode 21 and the resistor 22 is applied to the base of a transistor 24 whose collector is connected to the positive line 9. In the emitter circuit of the transistor 24, resistors 25, 26 and 27 are connected in series and a thermistor 28 whose resistance varies in response to changes in the temperature of the engine coolant is connected in parallel with the resistor 27. As a result, a reference voltage $V_a$ whose level changes in response to changes in the terminal voltage of the battery 3, and reference voltages $V_b$ and $V_c$ whose levels change in response to changes in the terminal voltage of the battery 3 and the temperature of the engine coolant, are taken from the emitter circuit of the transistor 24. In this embodiment, the level characteristics of the reference voltages $V_a$, $V_b$ and $V_c$ are determined in such a way that their respective levels increase with decreasing terminal voltage of the battery 3, and moreover the level characteristics of the reference voltages $V_b$ and $V_c$ are determined in such a way that their levels decrease with increasing coolant temperature.

The reference voltage $V_b$ is applied to a relay control circuit 31 for controlling the current flowing through the relay coil 5. The relay control circuit 31 has a voltage comparator 34 which has the second reference voltage $V_b$ applied to its positive input terminal through a resistor 35 and whose output voltage is fedback to the positive input terminal thereof through a diode 32 and a resistor 33. The negative input terminal of the voltage comparator 34 is connected to the anode of a diode 36 whose cathode is connected to ground through a capacitor 37 having a relatively large capacitance value.

In order to simulate the temperature of the glow plugs $2_1$ to $2_4$ by the charging/discharging voltage $V_0$ developed across the capacitor 37, a setting circuit 44 is provided between the switch 6 and the capacitor 37 for setting the charging/discharging characteristics of the capacitor 37. The setting circuit 44 is composed of resistors 38, 39 and 40, a variable resistor 41 and diodes 42 and 43. When the switch 6 is closed, the capacitor 37 is charged through the resistor 40 and the variable resistor 41 by the application of the voltage developed across the glow plugs since the diode 43 is biased in the forward direction and the diode 42 is biased in the backward direction. The charging characteristics of the capacitor 37 can be adjusted by the adjustment of the resistance value of the variable resistor 41, and the resistance value of the variable resistor 41 is adjusted in such a way that the curve of the voltage $V_0$ developed across the capacitor 37 in the charging operation corresponds to the curve representing the temperature rise of the glow plugs $2_1$ to $2_4$ upon the flow of current. On the other hand, when the switch 6 is thereafter opened, since the diode 42 is biased in the forward direction and the diode 43 is biased in the backward direction, the capacitor 37 is discharged through the resistor 39 and the glow plugs $2_1$ to $2_4$. The resistance value of the resistor 39 is selected in such a way that the curve of the voltage $V_0$ developed across the capacitor 37 in the discharging operation corresponds to the curve representing the temperature fall of the glow plugs $2_1$ to $2_4$.

For the purpose of triggering the voltage comparator 34 to assure that it will assume the high output level state when the ignition switch 4 is switched over from its OFF position to its ON position, a triggering circuit 47 composed of a capacitor 45 having a relatively small capacitance and a diode 46 is provided at the negative input terminal of the voltage comparator 34. The capacitor 45 is connected between the negative input terminal of the voltage comparator 34 and ground, and the diode 46 is connected between the negative input terminal thereof and the positive line 9.

With this arrangement, at the time when the ignition switch 4 is switched over from its OFF position to its ON position, the output level of the voltage comparator 34 becomes high because the capacitor 45 pulls down the potential at the negative input terminal of the voltage comparator 34 at this time. The charge of the capacitor 45 is discharged through the diode 46 when the ignition switch 4 is switched over to its OFF position to assure that the next triggering operation will be carried out. As described above, the voltage comparator 34 can be triggered by the use of a simple circuit.

The output terminal of the voltage comparator 34 is connected through a resistor 48 to the positive line 9 and is connected through resistors 49 and 50 and diodes 51 and 52 to ground. The voltage developed across the resistor 50 is applied between the base and the emitter of a transistor 54 whose collector circuit has a relay 53. When the output level of the voltage comparator 34 becomes high, the transistor 54 is turned ON to energize a coil $53_a$ of the relay 53, so that the normally open switch 55 of the relay 53 is closed. One terminal of the switch 55 is connected to the stationary contact $4_a$ and the other terminal of the switch 55 is grounded through the relay coil 5. Consequently, when the transistor 54 is turned ON in the case that the ignition switch 4 is switched over to its ON or its ST position, the relay coil 5 is energized to close the switch 6, so that current flows through the glow plugs $2_1$ to $2_4$. Diodes 56 and 57 are elements for preventing the transistor 54 from being destroyed, and a diode 58 is provided for absorbing surge voltage.

For the purpose of applying a predetermined constant voltage less than the reference voltage $V_b$ to the capacitor 37 when the ignition switch 4 is in its ON position and the switch 6 is opened, there is provided a constant voltage applying circuit 62 composed of resistors 59 and 60 and a diode 61. In the constant voltage applying circuit 62, the resistors 59 and 60 are connected in series, and the series connected circuit is connected between the collector of the transistor 54 and ground. Furthermore, the anode of the diode 61 is connected to the connecting point of the resistors 59 and 60, and the cathode of the diode 61 is connected to the high voltage side terminal of the capacitor 37. Therefore, for the ON state of the transistor 54, the potential at the anode of the diode 61 is approximately equal to ground potential, so that the circuit 62 does not influence the charging/discharging operation of the capacitor 37 at all. However, for the OFF state of the transistor 54, if the voltage drop at the diode 61 is not taken into consideration, the charged voltage $V_0$ developed across the capacitor 37 never becomes less than the potential at the anode of the diode 61.

With the constant voltage applying circuit 62, even though the capacitor 37 is discharged through the diode 42, the resistor 39 and the glow plugs $2_1$ to $2_4$ when the output level of the voltage comparator 34 changes to low level after the glow plugs are heated to a predetermined temperature, the charge of the capacitor 37 does not fall below the predetermined voltage level provided by the constant voltage applying circuit 62. On the other hand, the potential on the positive input terminal of the voltage comparator 34 is pulled down to below the voltage applied to the capacitor 37 by the constant voltage applying circuit 62 due to the feedback circuit composed of the resistor 33 and the diode 32, so that the output level of the voltage comparator 34 is maintained at low level. As a result, even if the temperature of the glow plugs decreases below the predetermined value because of the cutting off of the heating current, the glow plugs are not again heated by the control circuit. That is, in this case, the constant voltage applying circuit 62 is operated as a circuit for preventing the glow plugs from being heated again after cutting off the heating current.

Moreover, if such a voltage is applied to the capacitor 37 by the constant voltage applying circuit 62, in the case where the ignition switch is switched over to its ON position again just after being turned OFF to stop the engine, the voltage across the capacitor 37 will be equal to a predetermined voltage applied by the constant voltage applying circuit 62. Therefore, the capacitor 37 starts to be charged from the predetermined high voltage level corresponding to the actual temperature of the glow plugs, so that the glow plugs, whose temperature is already high due to the engine operation, can be effectively prevented from being excessively heated.

The control circuit 1 further comprises a lamp control circuit 64 for controlling the lighting of a lamp for indicating the heating operation of the glow plugs in relation to the heating operation controlled by the relay control circuit 31. The lamp control circuit 64 has a voltage comparator 65 having a negative input terminal which is connected to the negative input terminal of the voltage comparator 347 and the reference voltage $V_c$ ($<V_b$) is applied through a resistor 66 to the positive input terminal of the voltage comparator 65. The output terminal of the voltage comparator 65 is connected through a resistor 67 and a diode 68 to the positive input terminal thereof and is connected through a resistor 69 to the positive line 9. The output terminal of the voltage comparator 65 is also grounded through resistors 70 and 71 and diode 72, and the voltage developed across the resistor 71 is applied to a driving circuit 75 composed of transistors 73 and 74 which are arranged in darlington connection. A lamp 63 is connected to the collector circuits of the transistors 73 and 74. Consequently, when the level of the negative input terminal of the voltage comparator 65 is not more than $V_c$, the output level of the comparator 65 is high, so that the transistors 73 and 74 are ON to light the lamp 63. When the level of the negative input terminal increases with increasing temperature of the glow plugs and becomes greater than $V_c$, the lamp 63 is turned OFF. In this case, since the reference voltage $V_c$ applied to the positive input terminal is lower than $V_b$, the lamp 63 is first turned OFF in response to the increase in the temperature of the glow plugs, and then, the current flowing through the glow plugs is cut off when the voltage at the negative input terminal of the voltage comparator 34 is further increased to exceed the voltage $V_b$.

The control circuit 1 further comprises a coolant temperature detecting circuit 76 including a comparator 79. The reference voltage $V_a$ is divided by resistors 77 and 78 and the resulting voltage is applied to the negative input terminal of the comparator 79 to whose positive input terminal the reference voltage $V_c$ is applied. The resistance values of the resistors 77 and 78 are selected in such a way that the input level at the negative input terminal is larger than the voltage $V_c$ when the coolant temperature is larger than a predetermined value, so that the output level of the comparator 79 becomes low when the coolant temperature is larger than a predetermined value. As a result, for coolant temperatures larger than a predetermined value, the level at the output terminal of the comparator 34 is lowered to the ground level through a diode 80, forcibly turning OFF the transistor 54 regardless of the operating condition of the comparator 34, so that the glow plugs are controlled so as not to be heated.

The collector of the transistor 54 is connected to the negative input terminal of the comparator 79 through a diode 81 and a resistor 82, and the output level of the comparator 79 is locked at a low level when the collector voltage of the transistor 54 is increased. In this case, since both input levels of the comparator 79 are changed in response to changes in the battery voltage, the operation of the coolant temperature detecting circuit 76 is free from the influence of changes in the battery voltage, so that the operation is carried out in response to only the change in the coolant temperature.

The operation of the control circuit 1 shown in FIG. 1 will now be described with reference to FIGS. 2A to 2E.

When the ignition switch 4 is switched over from its OFF position to its ON position at the time $t_1$, due to the operation of the triggering circuit 47, the output levels of the comparators 34 and 65 become high. As a result, the transistor 54 is turned ON to close the switch 6, so that current starts to flow through the glow plugs $2_1$ to $2_4$ and the glow plugs are heated. If the coolant temperature is larger than a predetermined value in this case, the heating operation of the glow plugs is inhibited by the operation of the coolant temperature detecting circuit 76. At this time, the lamp 63 is lighted by the lamp control circuit 64 to let the operator know that the glow plugs are being heated. When the switch 6 is closed, the charging current starts to flow through the diode 43 to the capacitor 37, so that the voltage $V_0$ increases in accordance with the increase in the temperature of the glow plugs (FIGS. 2D and 2E).

When the charged voltage $V_0$ of the capacitor 37 becomes larger than $V_c$ at the time $t_2$, although the lamp 63 is turned off, the heating operation for the glow plugs is further maintained. The setting circuit 44 is adjusted in such a way that the glow plug temperature T reaches an optimum temperature $T_0$ at the time when the charged voltage $V_0$ of the capacitor 37 becomes larger than $V_b$. The transistor 54 is turned OFF at the time $t_3$, so that the switch 6 is opened to stop the heating operation. Therefore, the temperature T gradually decreases after the time $t_3$. At this time, the capacitor 37 is in discharging condition, and the voltage $V_0$ decreases in accordance with a characteristic curve approximately corresponding to the characteristic curve of the decrease in temperature. As described above, when the transistor 54 is turned OFF after once being turned ON, the operation of the constant voltage applying circuit 62 prevents the voltage $V_0$ across the capacitor 37 from being lowered below a predetermined value. Moreover, since the potential at the positive input terminal of the comparator 34 is suppressed by the operation of the feedback circuit composed of the resistor 33 and the diode 32 so as to be less than the constant voltage provided by the constant voltage applying circuit 62, the heating operation for the glow plugs is not carried out repeatedly, even if the ignition switch 4 is maintained in its ON position.

During the operation described in the foregoing, since the reference voltages $V_b$ and $V_c$ applied to the comparators 34 and 65, respectively, change in level in accordance with the change of the battery voltage, as long as the temperature of the coolant is constant, even if the battery voltage changes during charging of the capacitor 37, the change in the battery voltage is compensated for by the change in the levels of the reference voltages $V_b$ and $V_c$. Consequently, the glow plug temperature at the time when the lamp 33 is turned off and the temperature at the time when the heating operation is finished, are maintained at a predetermined value even when the battery voltage changes.

When the ignition switch 4 is switched over to its ON position to crank the engine again at the time $t_5$ after the ignition switch 4 has once been switched over to its OFF position at the time $t_4$, the capacitor 37 is not charged from zero volts but is charged from a predetermined charged value corresponding to the temperature of the glow plugs at that time. Therefore, in the period from $t_5$ to $t_7$, the curve showing the charging voltage of the capacitor 37 (FIG. 2E) is also approximately coincident with the temperature curve shown in FIG. 2D. Consequently, in re-start operation, the glow plug temperature at the time $t_6$ when the lamp 63 is turned off and the glow plug temperature at the time $t_7$ when the heating is finished are constant values, as long as the coolant temperature is constant.

When the ignition switch 4 is switched over to its ST position at the time $t_8$, since the base of the transistor 54 is connected through the resistor 83 to the positive terminal of the battery 3, the diodes 51 and 52 are biased in the backward direction to turn ON the transistor 54 so that the glow plugs are heated regardless of the low output level of the comparator 34.

The operation will be now described for the case in which the ignition switch is switched over to its OFF position at the time $t_{10}$ after the engine once started at the time $t_9$, and then, the ignition switch is switched over to its ON position again at the time $t_{11}$. At the time $t_{10}$, the value of voltage $V_0$ is less than $V_b$ due to the operation of the constant voltage applying circuit 62, and the glow plug temperature T is at a temperature less than $T_0$ because the engine has just stopped. Between $t_{10}$ and $t_{11}$, the voltage $V_0$ and the glow plug temperature T have a tendency to decrease gradually. In such a state, when the ignition switch 4 is switched over to its ON position again at time $t_{11}$, the glow plugs are heated for a short time since the capacitor 37 is charged to a predetermined level in advance. Consequently, the glow plugs which are in high temperature state due to the engine operation are effectively prevented from being excessively heated.

Furthermore, since the control circuit is so arranged that the reference voltage $V_b$ and $V_c$ are changed in level in response to the coolant temperature, as illustrated in FIG. 3 by solid line, the time $T_r$ required for heating the glow plugs to the predetermined temperature is decreased with the increase in the coolant temperature $T_w$. Also, the time $T_r$ will increase as the battery voltage $V_B$ decreases. As a result, the amount of energy supplied for heating the glow plugs is decreased when the coolant temperature $T_w$ is high, while the amount of energy supplied for heating the glow plugs is increased when the coolant temperature $T_w$ is low. Consequently, it is possible to always control the glow plug temperature to a predetermined value even if the coolant temperature $T_w$ varies.

FIG. 3 also shows the characteristic curves (broken lines) for the relationships between the lighting time $T_p$ and the coolant temperature $T_w$ for various battery voltages $V_B$.

According to the present invention, since the levels of the reference voltages are controlled in accordance with the battery voltage and the coolant temperature, the glow plugs can be always heated to a predetermined temperature for any coolant temperature regardless of changes in the battery voltage. Furthermore, since the control circuit is so arranged that a predetermined voltage is applied to a capacitor in the circuit for producing a charged/discharged voltage corresponding to the temperature change characteristics, the conventional complex circuit for preventing the glow plugs from overheating is not required. And moreover, although the voltage appearing at the charge lamp terminal of the dynamo with which the engine is equipped is provided to the control circuit in order to prevent the glow plugs from being overheated when the engine is started again just after once being stopped, overheating will be prevented without the application of the voltage appearing at the charge lamp terminal. Consequently, the control circuit is simplified and the reliability is improved.

We claim:

1. A circuit for controlling glow plug energization for use with a diesel engine having at least one glow plug energized by actuation of an ignition switch having an OFF position, an ON position for connecting said circuit to a power sources and an ST position for starting the diesel engine, said circuit comprising:

a first circuit means for producing a simulation voltage signal with a level which changes substantially in accordance with the change of glow plug temperature upon glow plug energization and deenergization;

a second circuit means for generating a first reference voltage signal with a level which is determined in relation to a desired glow plug temperature and which is changed in magnitude in response to the change in the voltage of said power source and the temperature of the engine coolant, the magnitude of said reference voltage signal being changed inversely with changes in the voltage of said power source;

means for comparing the level of said simulation voltage signal with that of said first reference voltage signal; and a switching means responsive to the resulting output of said comparing means for controlling the flow of current from said power source to the glow plug to energize the glow plug, whereby the glow plug is energized so as to be heated to said desired glow plug temperature.

2. A circuit means as claimed in claim 1 wherein said first circuit has a capacitor and a setting circuit which provides a path for charging or discharging said capacitor in response to the operation of said switching means, to produce a charged/discharged voltage as said simulation voltage signal, whereby the instantaneous level of the charged/discharged voltage is indicative of glow plug temperature at that instant.

3. A circuit as claimed in claim 2 wherein said capacitor is charged by a voltage developed across the glow plug.

4. A circuit as claimed in claim 2, further comprising: a third circuit means for applying a charging voltage with a predetermined level to said capacitor when said ignition switch is switched over to its ON position and said switching means is OFF.

5. A circuit as claimed in claim 1 wherein said comparing means involves hysteresis in its comparing operation.

6. A circuit as claimed in claim 1 wherein said switching means has a relay having a switch connected between said glow plug and said power source and a driving circuit responsive to the resulting output signal from said comparing means for energizing/deenergizing said relay to close/open the switch.

7. A circuit for controlling glow plug energization for use with a diesel engine having at least one glow plug energized by actuation of an ignition switch having an OFF position, an ON position for connecting said circuit to a power source and an ST position for starting the diesel engine, said circuit comprising:

a first circuit means for producing a simulation voltage signal with a level which changes substantially in accordance with the change of glow plug temperature upon glow plug energization and deenergization;

a second circuit means for generating a first reference voltage signal with a level which is determined in relation to a desired glow plug temperature and which is changed in magnitude in response to the change in the voltage of said voltage source and the temperature of the engine coolant;

means for comparing the level of said simulation voltage signal with that of said first reference voltage signal; and a switching means responsive to the resulting output of said comparing means for controlling the flow of current from said power source to the glow plug to energize the glow plug, whereby the glow plug is energized so as to be heated to said desired glow plug temperature, wherein said second circuit has a generator for generating a second reference voltage whose level changes in response to the change in the voltage level of said power source, and a voltage divider which changes in dividing ratio in accordance with the coolant temperature and divides said second reference voltage to produce said first reference voltage signal.

8. A circuit as claimed in claim 7, further comprising: a detecting circuit means responsive to said second reference signal and a signal related to said first reference signal for detecting that the coolant temperature is larger than a predetermined value, means responsive to the output signal of said detecting circuit for forcibly turning said switching means OFF to inhibit the current from flowing through the glow plug and means responsive to the turning OFF of said switching means for applying a signal of said detecting circuit means to maintain said switching means OFF.

9. A circuit for controlling glow plug energization for use with a diesel engine having at least one glow plug energized by actuation of an ignition switch having an OFF position, an ON position for connecting said circuit to a power source and an ST position for starting the diesel engine, said circuit comprising:

a first circuit means which includes a capacitor and produces a simulation voltage signal by charging/discharging said capacitor, the level of said simulation voltage signal being changed substantially in accordance with the change of glow plug temperature upon glow plug energization and deenergization;

means for comparing the level of said simulating voltage signal with a reference voltage signal;

a switching means responsive to the resulting output of said comparing means for controlling the flow of the current from said power source to the glow plug to energize the glow plug to heat the glow plug to the desired glow plug temperature; and a circuit means for applying a charging voltage of a predetermined level to said capacitor when said diesel engine is running to maintain a predetermined charge level for said capacitor corresponding to the temperature of said glow plug so that when said ignition switch is switched Off and then switched over to its ON position and said switching means is OFF, said glow plugs will not be overheated.

10. A circuit as claimed in claim 9 wherein said first circuit means has means including a setting circuit for providing a path for charging or discharging said capacitor in response to the operation of said switching means to produce a charge/discharge voltage as said simulation voltage signal, whereby the instantaneous level of the charged/discharged voltage is indicative of glow plug temperature at that instant.

* * * * *